US005454679A

United States Patent [19]

Whiteman

[11] Patent Number: 5,454,679

[45] Date of Patent: Oct. 3, 1995

[54] WIRE ELEMENT BINDERY PRESS

[76] Inventor: Marvin E. Whiteman, Jr., 1175 Boeing St., Boise, Id. 83705

[21] Appl. No.: 182,482

[22] Filed: Jan. 13, 1994

[51] Int. Cl.[6] ..... B42B 5/10

[52] U.S. Cl. ..... 412/39

[58] Field of Search ..... 412/9, 22, 33, 412/38, 39

[56] References Cited

U.S. PATENT DOCUMENTS

| | | | |
|---|---|---|---|
| 3,945,073 | 3/1976 | Adams | 412/39 |
| 4,398,856 | 8/1983 | Archer et al. | 412/39 |
| 4,934,890 | 6/1990 | Flatt | 412/39 |
| 5,059,078 | 10/1991 | Schmid | 412/39 |
| 5,197,842 | 3/1993 | Bross | 412/39 |

*Primary Examiner*—Willmon Fridie
*Attorney, Agent, or Firm*—Frank J. Dykas

[57] ABSTRACT

A combination work station for open wire element bindery operations is provided with a base plate having a planar work surface with a die punch for perforating pages resting upon a first work station on the work surface, and the bindery press for pressing closed open wire binding elements at a second work station on the common work surface. The bindery press is manually operated and is provided with a moving platen sliding upon inserted guide posts extending normally up from the work surface. Adjustment means incorporating adjustment screws interfitting through threaded traveler blocks attached to the platen are provided. Compressive coil springs circumvolving the adjustment screws provide compressive force for returning the press from its closed to open position.

5 Claims, 3 Drawing Sheets

WIRE ELEMENT BINDERY PRESS

BACKGROUND OF THE INVENTION

1. Field of Invention

This invention relates generally to devices for page binding and closing open wire element into bound books. More specifically this invention relates to a bindery press work station and binder press for hole punching, introducing continuous wire element into pages and closing the open wire elements.

2. Technical Field

Open-wire binding presents a number of advantages over spiral binding as a means of binding pages in a book. With open-wire binding the pages turn more freely and are not hindered by the wire binding. Additionally open-wire binding allows greater flexibility in the amount of pages to be fastened, as the wire element can be adjusted to accommodate varying amounts of pages. The amount of pages that can be accepted by the dye-punch and punched at one time is referred to as a lift of pages and more commonly simply as a "lift".

In open wire binding, the pages to be bound are first punched in a stand-alone die punch which perforates the pages to form either square or rectangular holes, usually at the frequency of either two or three holes to the inch. The pages are then inserted over the wire tracks of the open wire element. The open wire element, which is open in "C" shaped fashion, is then inserted into a separate mechanical press, wherein an elongated platen is used to apply uniform pressure to all of the tracks of the wire elements to close them to a circular shape of a predetermined diametric size, thus binding the pages to form the book.

The machines that exist presently possess a number of shortcomings. Firstly, once a lift of pages is punched it must be removed by the operator to another work station where the wire element is installed; the lift of pages is difficult to handle without causing the holes in the sheet to fall out of alignment. Secondly, once a lift of pages has been moved and the holes are out of alignment, the wire element is more difficult to install, particularly if the finished "book" is composed of a plurality of lifts. Thirdly, the wire-element-installing press or wire closer possesses a fixed-spring mechanism for resetting the press to the open position after pressing closed an open wire element to bind a book. As a result of the fixed spring, it is necessary to apply greater compression force to the press when smaller diameter wire-element binding is being performed and consequently it is more difficult to create smaller diameter wire element bindings. In addition to these limitations, the existing equipment is also expensive to produce.

Accordingly, it is an object of this invention to provide an improved and more economical bindery press for inserting wire element binding wherein the lift of punched pages remains on a common surface between the hole punching site and the wire-element insertion site, thereby creating a continuous and common work station for the performance of both the hole-punching and wire element insertion and closing.

It is an additional object of this invention to provide a page-access opening in the surface of the work station that allows improved handling of the lift of pages after the holes have been punched to prevent the holes from becoming misaligned.

It is a further object of this invention to provide a fixed-compression screw with a traveler assembly in the wire-element press, to provide uniform resistance to the compression required irrespective of the diameter of wire element binding being performed.

DISCLOSURE OF INVENTION

These objects are achieved in a combination work station which incorporates a common base plate having two work surfaces. One side of the station and the first work surface is dedicated to a die punch assembly for making the necessary perforations in the pages prior to binding, and the second work station on the base plate is dedicated to a manually operated bindery press.

In operation, the operator of the combined bindery work station first inserts a lift of pages into the receiving slot of a conventional die hole punch and manually perforates the pages. An open wire binding element is inserted into a binding element cradle, and the lift of now perforated pages are hung from the wire tracks of the open binding wire element. Multiple lifts can be assembled into a single common wire element by simply repeating the die punching operation for the required number of lifts.

Once the document has been assembled on the open wire element, the open wire element, together with the attached pages, are slid out of the cradle and positioned beneath the bindery platen of the bindery press. The bindery platen is then manually operated to compress the open wire element to form the intended circular binding element which holds the pages together.

The bindery press is provided with an elongated bar-shaped platen which is kept in parallel alignment to the work surface by means of a pair of guide bars attached to and extending normally up from the work surface.

To adjust the varying sizes of open wire elements, an adjustment mechanism is provided for setting the height of the platen when in use. This adjustment mechanism utilizes a pair of adjustment screws, one of which is threaded into traveler screws fixed to each end of the platen. By turning the adjustment screw, the height of the platen can be adjusted up or down, as the case may be. By having an adjustment assembly at each end of the platen, alignment of the platen parallel to the work surface can be maintained.

The adjustment screws are not fixably attached to anything other than the traveler nuts, and as a result, as the platen is pushed down to compress an open wire rim, the traveler screws will also move downward. To hold the platen in position, the adjustment screws are provided with circumvolving coil springs, each of which are held atop the work surface by means of a thrust washer, and held from upward travel against a circumvolving flange fixably attached to the traveler screws.

As the adjustment screws accompany the platen as it is pushed downward, they interfit into receiving holes in the work station so as to permit full travel of the platen. As this occurs, the coil springs grow into compression against the retaining flanges to provide a resistive force used to return the platen from its pressing position back to its designed open position. This compressive force is independent of the position of the pressing platen, and as a result, remains constant regardless of the actual height adjustment of the platen.

BEST MODE FOR CARRYING OUT INVENTION

Figure 1:
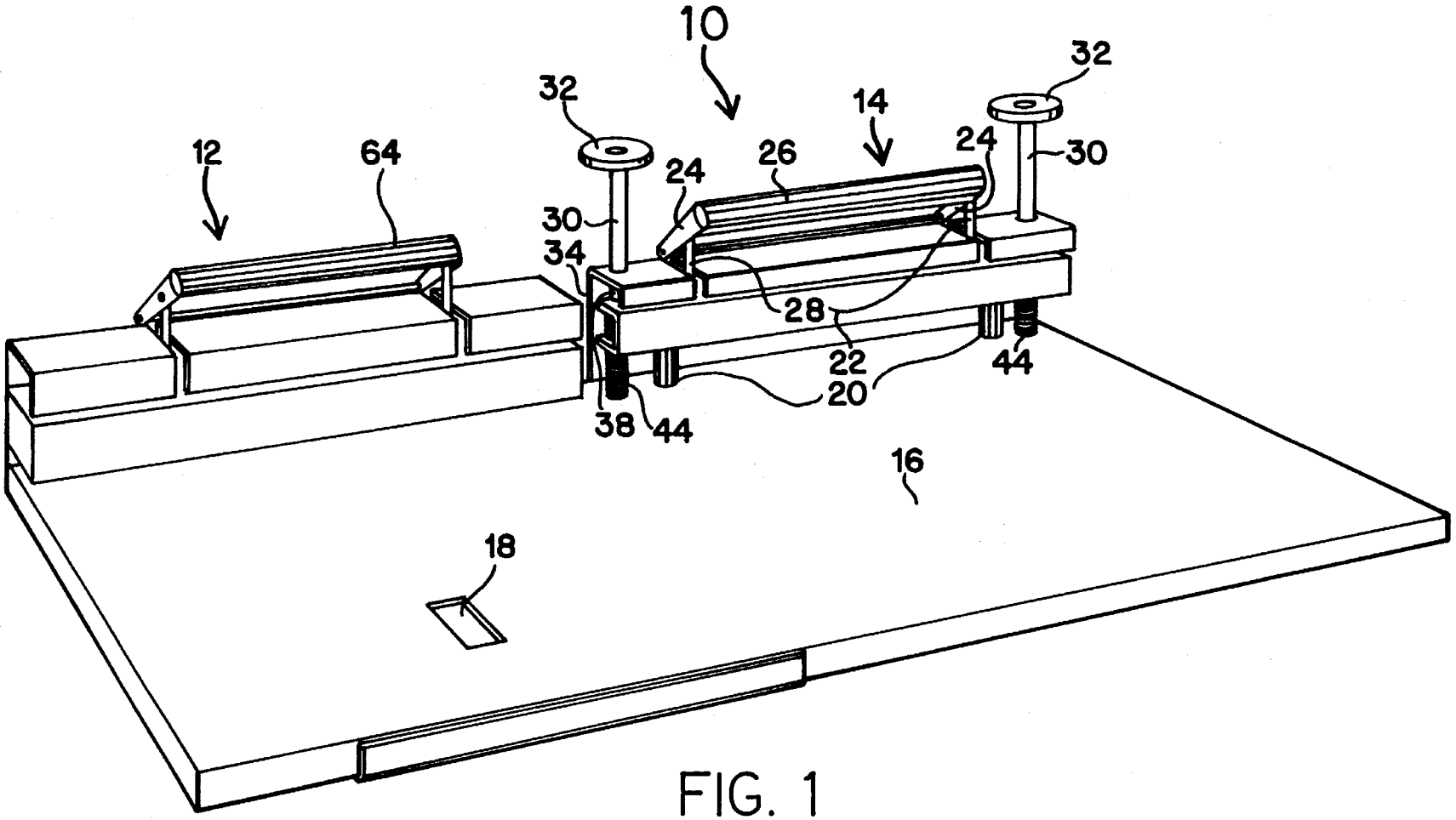
FIG. 1 is a perspective representational view of the combination work station.
Figure 2:
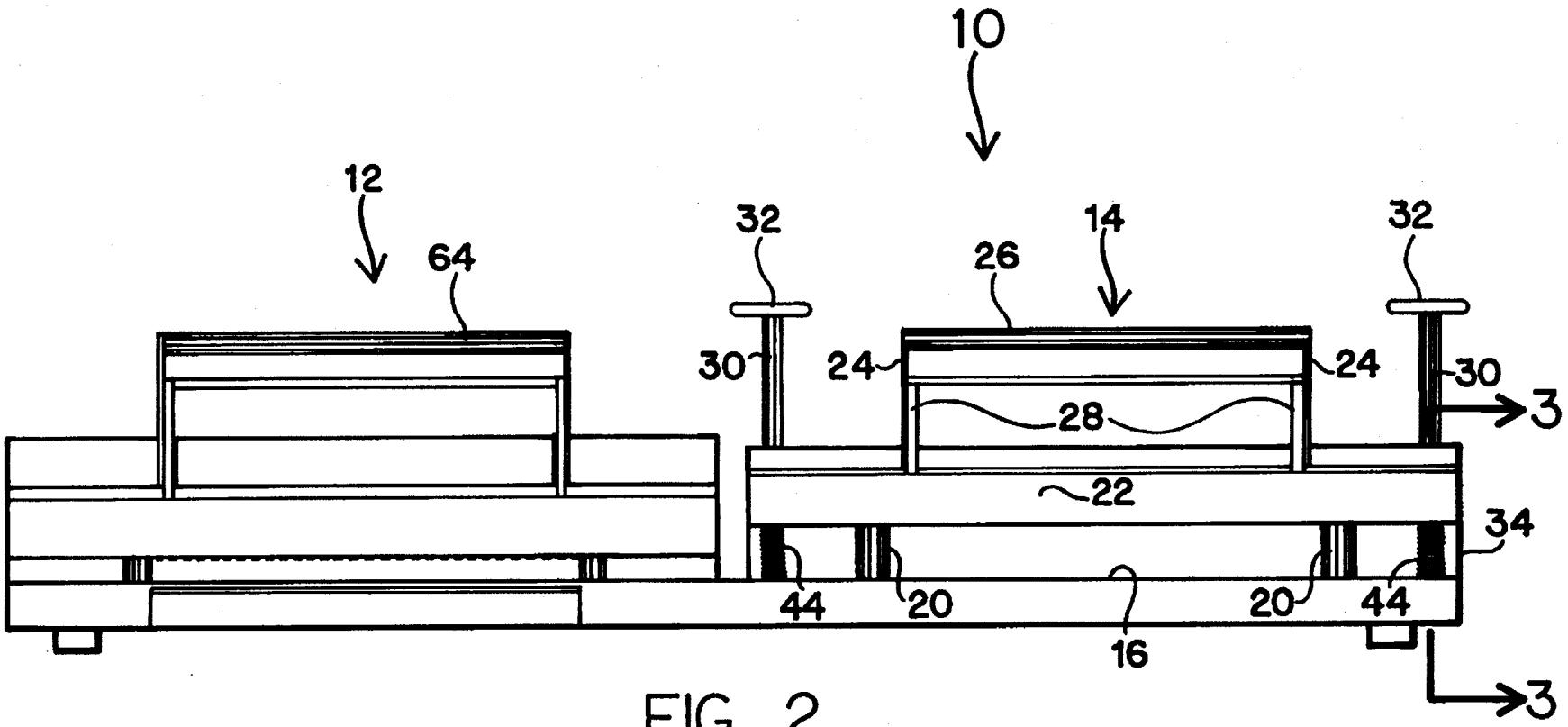
FIG. 2 is a front view of the binding press.

In the preferred embodiment of the present invention, as shown in FIGS. 1 and 2, the combination work station 10 incorporates a common base plate having work surface 16. One side of the station, called the first working surface, is devoted to die punch 12 for making the necessary perforations in the pages prior to binding, and on the other side, the second working surface, is my new improved wire-element bindery press. In the preferred embodiment, both die punch 12 and bindery press 14 are manually operated.

In operation, the operator of combined bindery work station 10 first inserts a lift of pages into the receiving slot of the conventional die hole punch 12 and manually punches the holes by operation of the die hole punch handle 64. In typical open wire binding, holes are punched or perforated at the rate of either two or three holes per inch, and sized to accept the wire tracks of the open wire element. The binding open wire elements are commonly available and utilized in sizes ranging from 3/16" to 1" in diameter when closed. As can be seen in FIG. 1, page access opening 18 is provided in the planar work surface 16 to permit the operator to grasp the lift of pages simultaneously from both the top and bottom, thereby reducing the chances of misaligning the various pages and in the lift when picking it up and removing it from the dye punch 12.

An open wire element is inserted in wire element cradle 60 and is in a position where the operator can easily hang the pages on the wire element by hanging the lift of pages upon the wire tracks of wire element 62. Multiple lifts can be assembled on a single common wire element 62 by simply repeating the dye punching operation for the required number of page lifts needed to assemble the entire document.

Once the document has been assembled on the open wire element 62, open wire element 62, together with the now attached pages are slid out from cradle 60 and positioned beneath the bindery platen 22 of bindery press 14.

Figure 3:
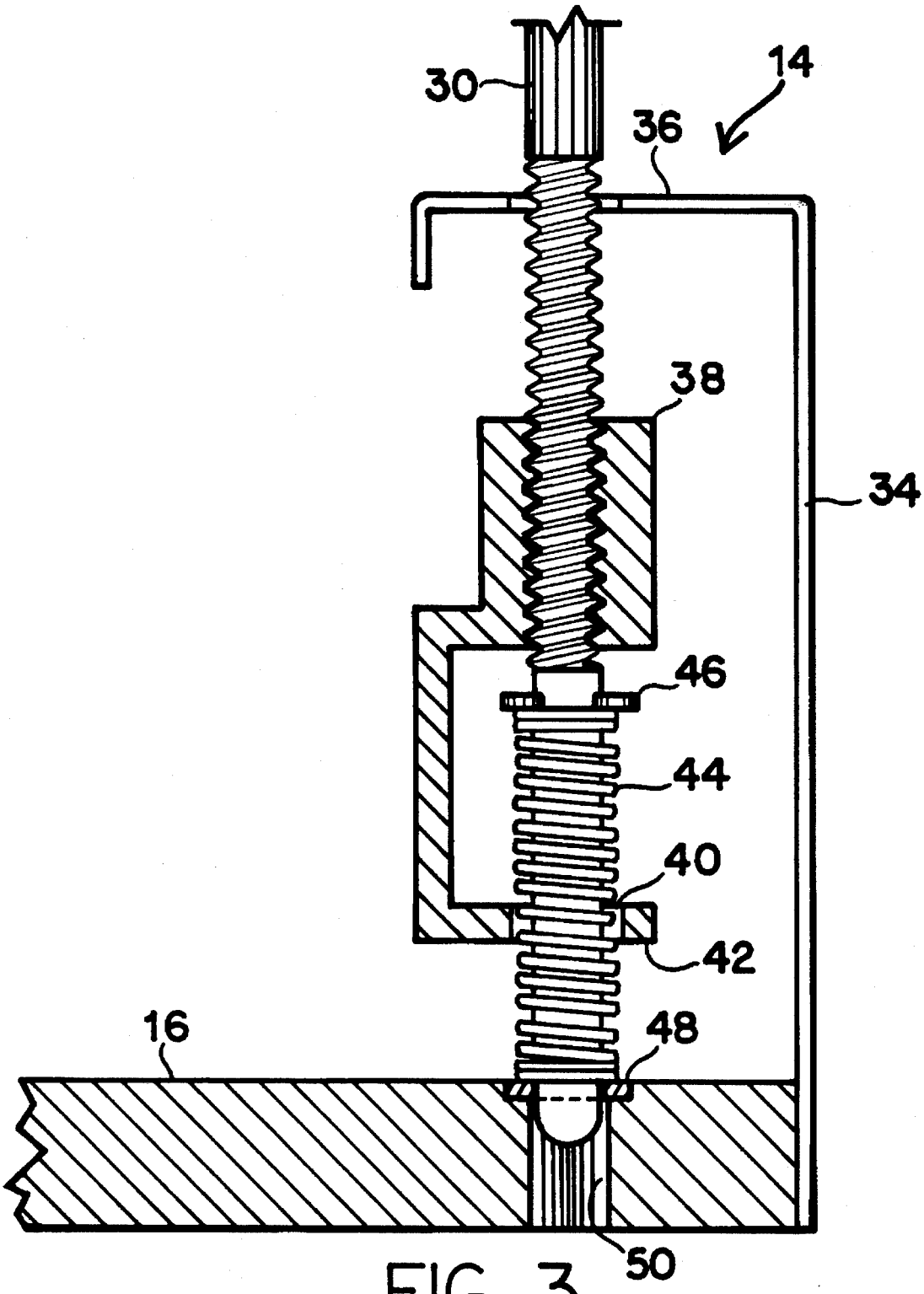
FIG. 3 is a sectional side view of the binding press taken along plane 4 as shown in FIG. 3.

As previously stated, bindery press 14 is manually operated. As shown in FIGS. 2 and 3, bindery press 14 is formed of a frame assembly having a pair of platen guide bars 20 attached to and extending normally up from work surface 16 which interlock with the top planar extension 36 of back plate 34, to form a rigid frame.

Elongated bar-shaped platen 22 is provided with guide bar holes 66 through which guide bars 20 slidably interfit, thus providing for proper alignment of platen 22 as it is pushed down in the pressing action to the press position and returned up during retraction after pressing to the open position. Mode of power for the pressing operation is provided by a handle assembly which has a pair of handle arms 24 pivotably hinged to back plate 34 and cross bar handle 26. Extending down in the proper location are a pair of press extensions 28 which transmit the leveraged force from handle 26 to platen 22 to push it down.

As previously stated, open wire elements come in a variety of sizes, usually ranging from 3/16" to 1". As a result, the amount of travel for platen 22 will vary with the diameter of the open wire elements being closed. For that reason, an adjustment mechanism for setting the height of platen 22 when in the fully open position is provided. This adjustment mechanism utilizes a threaded traveling adjustment screw 30 which interfits in threadable engagement with traveler 38 formed integral with platen 22. The adjustment screw is encased, at its lower end, within coil spring 44, and is held on top of work surface 16 by means of thrust washer 48. At its upper end, the coil spring 44 is held in place around adjustment screw 30 by means of circular retaining flange 46. Retaining flange 46 is fixed to adjustment screw 30. In this configuration, adjustment screw 30 is resiliently held by spring 44 atop work surface 16. Thus, height adjustments for platen 22 can be made by turning adjustment screws 30 to cause travelers 38 of platen 22 to travel up or down a selected length of adjustment screw 30.

Since platen 22 is attached to both adjustment screws 30, as platen 22 is pushed down to compress an open wire loom binding element, adjustment screws 30 will also move downward. As a result, adjustment screw receiving guide holes 50 are provided in work surface 16 to enable downward motion to continue. Additionally, the pressing surface of platen 22 is provided with holes which are sufficiently large to enable the pressing surface to override that portion of screw 30 which is encased by spring 44, thus enabling adjustment of platen height without changing compressive spring forces.

As platen 22 is pushed downward, pressing surface 42 of platen 22 can extend down around that portion of adjustment screws 30 which is encased within spring 44. At the same time, adjustment screw 30 which are threadably attached to platen 22 by traveler blocks 38 will travel downward with platen 22. As adjustment screws 30 are moving downward, springs 44 will come under compression as retaining clips 46 move downward. The amount of this compressive force is independent of the adjusted position of platen 22, it being only dependent upon the positions of retaining rings 46. Thus, the same compressive force is encountered by platen 22 irrespective of the positioning of platen 22 as it is adjusted to compress varying diametric sizes of open wire looms.

While there is shown and described the present preferred embodiment of the invention, it is to be distinctly understood that this invention is not limited thereto but may be variously embodied to practice within the scope of the following claims.

I claim:

1. A combination work station for open wire element bindery operations which comprises:

a base plate having a planar working surface having a first and second work station for supporting a lift of pages;

a die punch for perforating pages to be inserted in an open wire binding element, configured to perforate lifts of pages resting atop a first work station on said planar working surface, attached to the base plate; and a bindery press having a moveable platen for pressing an open wire element from an open position to a closed position between said moveable platen and the second work station of the planar working surface, attached to the base plate.

2. The combination work station of claim 1 wherein said base plate further comprises a planar working surface having a hole therethrough at a location to expose an edge of a lift of pages positioned upon the first work station of said planar working surface.

3. A bindery press which comprises:

a base plate having a planar working surface;

a moveable platen having a plurality of guide post receiving holes;

a plurality of guide posts attached to and extending normally up from said planar working surface for slidable insertion into the guide post receiving holes of said platen for aligning said platen in parallel space relationship to the planar working surface, a moveable platen;

means for adjustably holding said platen in parallel space relationship with the planar working surface at a selectable open position distance from said planar working surface;

means for pushing the platen toward the planar working surface to a pressing position; and means for returning the platen from the pressing position to the open position.

4. The bindery press of claim 3 wherein the means for adjustably holding said platen further comprises:

a pair of traveler nuts, each attached to an end of the platen, said traveler nuts each having adjustment screw receiving hole therethrough for adjustably holding, in threaded engagement, an adjustment screw in normal alignment with the planar work surface;

a pair of adjustment screws each threadably engaged through the adjustment screw receiving hole of a traveler nut; and wherein said base plate is configured with adjustment screw sink holes for receiving without engagement an adjustment screw as the platen is pushed from the open position to the pressing position.

5. The bindery press of claim 4 wherein said means for returning the platen from the pressing position to the open position further comprises:

a coil spring circumvolving an interfitting portion of the adjustment screw between the planar work surface and a retaining ring; and a coil spring retaining flange attached to and circumvolving the adjustment screw for compressive engagement with the coil spring as the adjustment screw moves with the platen between the open and pressing positions.

* * * * *